United States Patent [19]

Weber

[11] 4,098,047

[45] Jul. 4, 1978

[54] JOINT SEALING METHOD

[75] Inventor: Victor Weber, Hinsdale, Ill.

[73] Assignee: W. R. Grace & Co., Cambridge, Mass.

[21] Appl. No.: 802,836

[22] Filed: Jun. 2, 1977

[51] Int. Cl.[2] ..... E04G 21/00

[52] U.S. Cl. ..... 52/741; 404/68

[58] Field of Search ..... 404/47–68, 404/69, 49; 52/396, 741, 100, 573

[56] References Cited

U.S. PATENT DOCUMENTS

| | | | |
|---|---|---|---|
| 2,951,001 | 8/1960 | Rubenstein | 52/309.17 |
| 3,368,464 | 2/1968 | Thorp | 404/49 |
| 3,884,000 | 5/1975 | Faleij | 52/573 |
| 3,977,802 | 8/1976 | Galbreath | 52/396 |

FOREIGN PATENT DOCUMENTS

| | | | |
|---|---|---|---|
| 549,606 | 8/1956 | Belgium | 52/396 |
| 1,332,483 | 6/1963 | France | 52/100 |
| 614,982 | 6/1935 | Fed. Rep. of Germany | 52/100 |
| 213,596 | 6/1967 | Sweden | 52/396 |
| 646,268 | 11/1950 | United Kingdom | 52/396 |
| 1,350,903 | 4/1974 | United Kingdom | 404/68 |

*Primary Examiner*—James L. Ridgill, Jr.
*Attorney, Agent, or Firm*—William L. Baker; C. E. Parker

[57] ABSTRACT

A method of sealing joints e.g. between concrete sections in road, bridge and parking deck structures against passage of water, dirt, etc., is described wherein recesses are formed in the concrete surface on each side of the joint and a specifically designed flexible elastic joint-spanning strip having openings therethrough is placed therein. A layer of rigid-setting grout is then placed over the strip, the openings in the strip when filled with grout serving to support the upper layer of grout and to prevent flexing and cracking thereof by vehicle traffic passing thereover, as well as to anchor the strip to the concrete bodies.

22 Claims, 7 Drawing Figures

FIG. 5
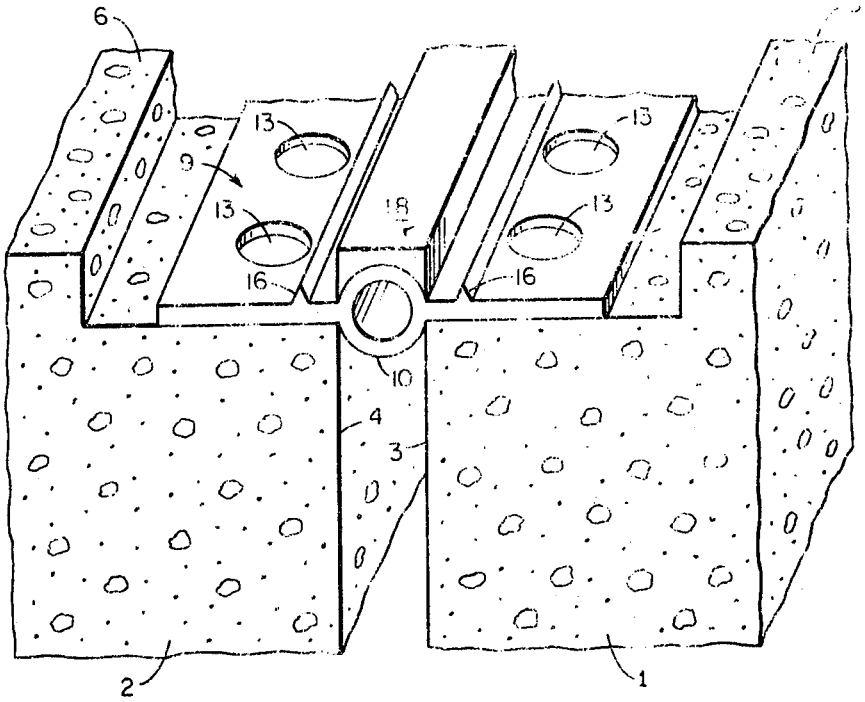
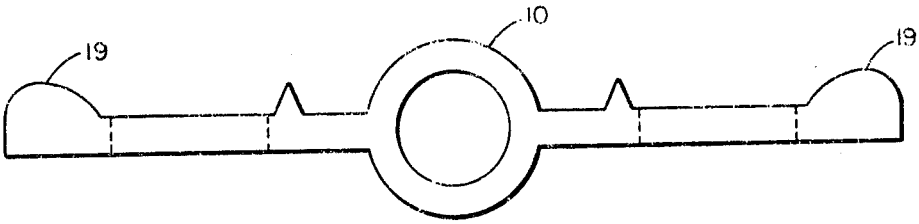
FIG. 6
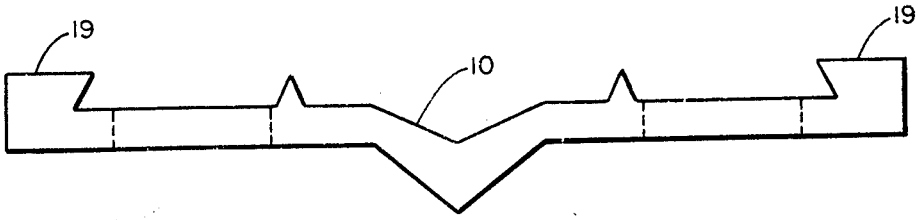
FIG. 7

JOINT SEALING METHOD

The present invention is directed to a method of constructing a joint between two masses of construction material, e.g. Portland cement concrete, using a flexible joint-spanning sealing element. In particular, the present invention concerns a relatively inexpensive method of sealing a joint between two relatively rigid masses of structural concrete by providing a flexible sealing element across such joint at, or near, the surfaces of the concrete masses, the joint thus being rendered proof against entry of foreign materials such as dirt, water, etc., even when the concrete masses move relative to one another. The inventive joint forming method finds particular utility in the formation of waterproof joints between sections of concrete masses used in roads, highways, bridges, parking decks, etc.

BACKGROUND OF THE INVENTION

In the construction of traffic-bearing or pavement structures such as roads, bridges, parking decks, etc., using large masses of rigid construction material such as Portland cement concrete, it is well known that joints must be provided for between the rigid masses at regular intervals to allow for movement of the rigid masses due to stresses caused by traffic, changes in temperature, etc. In constructions of this type moreover where a relatively large degree of movement is expected, for instance in elevated structures such as bridge and parking decks, so-called "expansion" joints are conventionally provided for between the concrete masses which can be up to about 3 to 4 inches in width.

Such joints or openings must be sealed in some manner in order to allow for smooth passage of traffic over the joint and/or to prevent foreign substances such as water, dirt, stones etc., from entering the joint. The means utilized to seal the joint must be able to accomodate movement of the respective concrete bodies either horizontally and/or vertically with respect to one another. The joint-sealing means must also be able to withstand traffic thereover for reasonable lengths of time.

The most popular methods of sealing such expansion joints in road bridges, parking decks, etc., make use generally of either a pair of coacting, opposed, comb-like steel members each locked to opposite edges of the separated concrete masses, or utilize a flexible, water-resistant joint-spanning member in the form of a continuous strip of synthetic elastomeric material, e.g. neoprene rubber, polyvinyl chloride, etc. The opposed, interfitting steel member-type joints provide for somewhat smooth passage of traffic thereover and accommodate movement, but usually permit passage of water and fine solids therethrough. Therefore these joints must be used in conjunction with some means of draining this water and fines below. This type of joint is obviously relatively expensive and subject to the corrosion of the metallic members.

Expansion joints using flexible joint-spanning members in the form of continuous strips are more economic than the interfitting steel member types. Most popular are joints which utilize tough preformed, flexible, hollow neoprene members which have the added advantage of preventing passage of water, sand, dirt, stone and road salts which in particular have a corrosive effect on reinforcing steel used in the concrete bodies. Such flexible sealing members may be simply forced into formed or sawed joints in the concrete bodies while the members are in a compressed state, the elastic properties of the sealing member serving to hold the member in place in the joints. In this case however the member is subject to becoming loose should the joint expand to a greater degree than expected. Also, the member is subject to being "sucked out" of the joint by traffic passing thereover.

Methods for anchoring such flexible joint-spanning members to the respective opposed concrete bodies of the joint have also been developed. In one popular method, exemplified in U.S. Pat. No. 3,598,026 to Johnson, the flexible sealing member has portions of its lateral edges secured into heavy metal anchoring members embedded into the opposed concrete bodies. The edges are shaped such that they resist withdrawal from the metal anchors. The metal anchors ideally resist the heavy stresses placed upon them by vehicular traffic passing over the joint. Metallic anchoring members however are expensive to manufacture, and are also costly to install since they usually require welding or drilling operations. Metal is moreover subject to corrosion, and corroded anchors are expensive to repair or replace. In a more recent expansion jointforming method exemplified in U.S. Pat. No. 3,981,601 to Arai, the lateral edges of the flexible joint-spanning member have openings preformed therethrough to receive bolts which anchor the flexible member to metallic members secured in the concrete. Again the use of such metal anchoring systems is relatively expensive. Also in the system shown in U.S. Pat. No. 3,981,601, the flexible sealing member is exposed to vehicle traffic which will cause the seal to wear at the portions where the seal is forced against the shoulders of the concrete bodies.

SUMMARY OF THE INVENTION

According to the present invention, a method of constructing a joint between two rigid bodies of construction material, particularly expansion joints of elevated traffic-bearing roadways, highways, bridges, parking decks and the like, has been developed which method provides a joint which will withstand traffic thereover, is proof against water, stones, sand and corrosive salts, and is comparatively simple and economic to install or replace. Briefly, in the method of the invention, a recess is formed in the portion of the upper surfaces of the opposed bodies of rigid construction material immediately adjacent the joint formed by the opposed bodies. The recessed surface is made smooth, if necessary by sanding or by applying a grouting material and thereafter a flexible elastic joint-spanning member in continuous strip-like form is layed in the recess in a manner such that the upper surface of the member is beneath the surfaces of the opposed concrete bodies. Importantly, the member has preformed openings through its lateral edges. Thereafter, a layer of grouting material less compressible than the joint-spanning member is placed over each of the lateral edges of the joint-spanning member, care being taken that the grouting material is forced into and frills the openings through the edges of the member. The upper surface layer of grouting material is made even and continuous with the surfaces of the concrete bodies.

The grouting material is selected such that it is sufficiently rigid to withstand being easily compressed by traffic passing over the joint. In this manner, the grout which has hardened in the openings in the joint-spanning member acts as a reinforcement of the upper grout layer, which would easily crack and crumble due to the passage of traffic thereover if it were merely supported by the compressible spanning member. The hardened grout in the openings also functions to lock the spanning member into the opposed concrete bodies.

The result is an economically-formed joint which makes use of the superior sealing ability of the preformed flexible, elastic joint-spanning member, without the member being subject to easy removal or to being "sucked-out" of the joint. The member moreover is secured without the necessity of using costly metallic anchoring members. Moreover, the flexible joint-spanning member is protected by an upper layer of more rigid grout so that it is not subject to rapid wear by the passage of traffic thereover. Other advantages will become obvious from the detailed description below.

BRIEF DESCRIPTION OF THE DRAWINGS

FIG. 5 is an illustration in perspective of a preferred method for forming the grout sections shown in FIG. 1; and FIGS. 6 and 7 are cross-sectional views of alternative embodiments of a joint-spanning strip for use according to the invention.

DESCRIPTION OF THE PREFERRED EMBODIMENTS

The preferred aspects of the method according to the invention are best described having reference to the attached drawings and the following detailed description.

Figure 1:
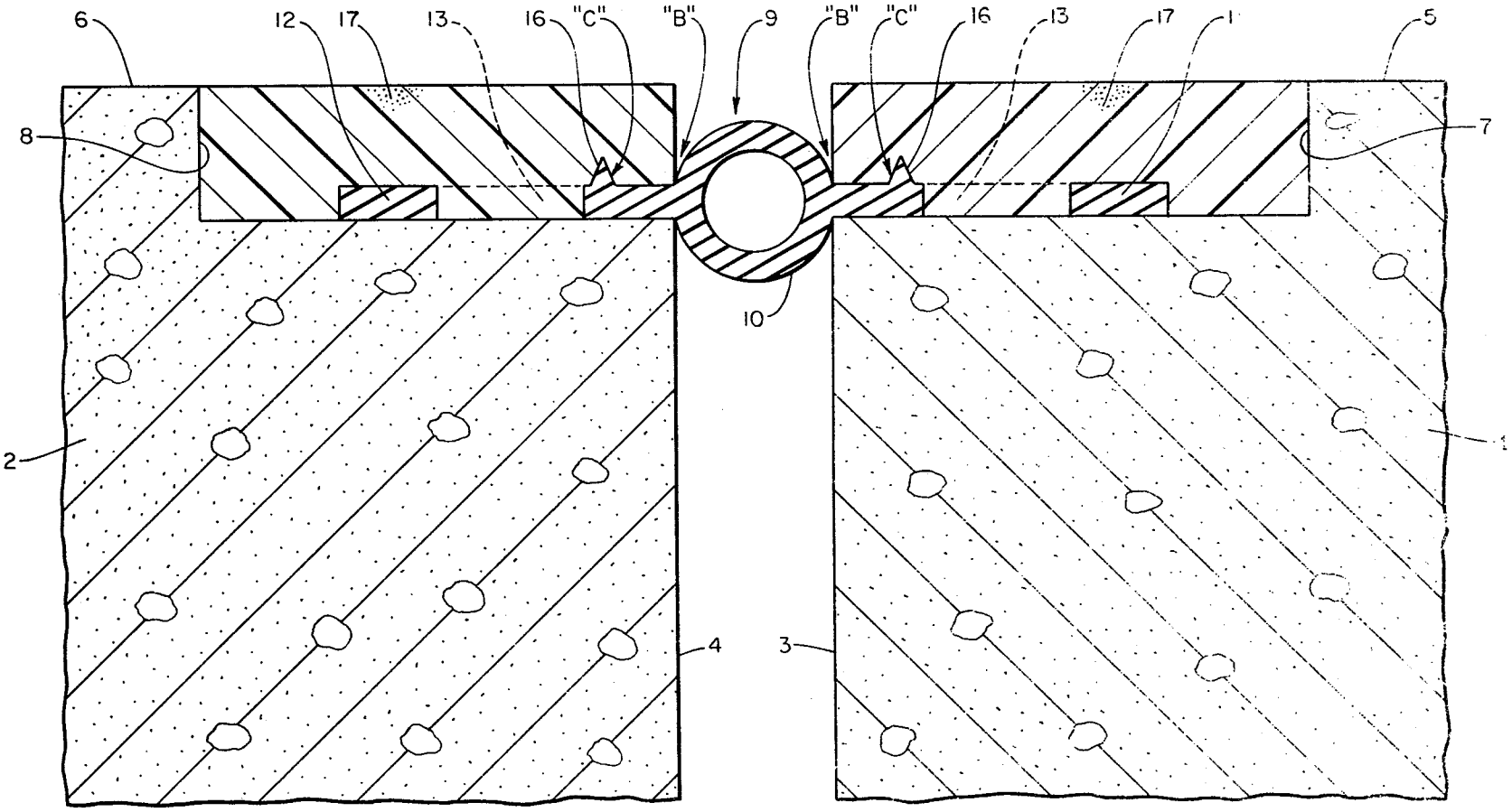
FIG. 1 is a cross sectional view of a sealed joint according to the invention, the section being taken across the lines A—A in FIG. 2.

FIG. 1 shows a vertical cross section of a horizontally extending joint formed between two horizontally cast sections of concrete 1 and 2. The joint has been sealed in the manner of the invention along its horizontal extent using a continuous strip 9, shown in perspective in FIG. 2 and as viewed from above in FIG. 3. The cross section illustrated in FIG. 1 is taken along the line A—A of FIG. 2. The joint shown in FIG. 1 is a typical "expansion" joint wherein a space, say about 1 inch wide, has been left between the concrete sections to allow for anticipated movement of the sections away from or toward one another. However, the joint may be other than an expansion joint, for instance a construction or a contraction joint.

In addition to opposed, joint-forming surfaces 3 and 4, each of the horizontally cast concrete sections 1 and 2 has a complementary, outer exposed, non-opposed surface, 5 and 6 respectively, which joins the opposed joint-forming surface at the locus of the joint. These exposed, non-opposed surfaces 5 and 6 may initially have actually been adjoining the opposed respective surfaces 3 and 4 at a right angle at the locus of the joint prior to the formation of recesses 7 and 8 and the recesses subsequently made, or the recesses 7 and 8 may have been formed during the casting of the concrete sections 1 and 2.

The exposed surfaces 5 and 6 further are surfaces which permit access to the joint for working purposes, that is, for installation of joint-spanning strip member 9. As pointed out above, the method of the invention has particular utility in the sealing of joints in roadways, bridge decks, parking garage decks, etc., where surfaces 5 and 6 are exposed to traffic, especially passage of heavy motor vehicles thereover. Passage of water through joints in such structures is particularly undesirable since it corrodes reinforcing metal in the concrete and leaves unsightly stains on the other side of the joints.

Figure 4:
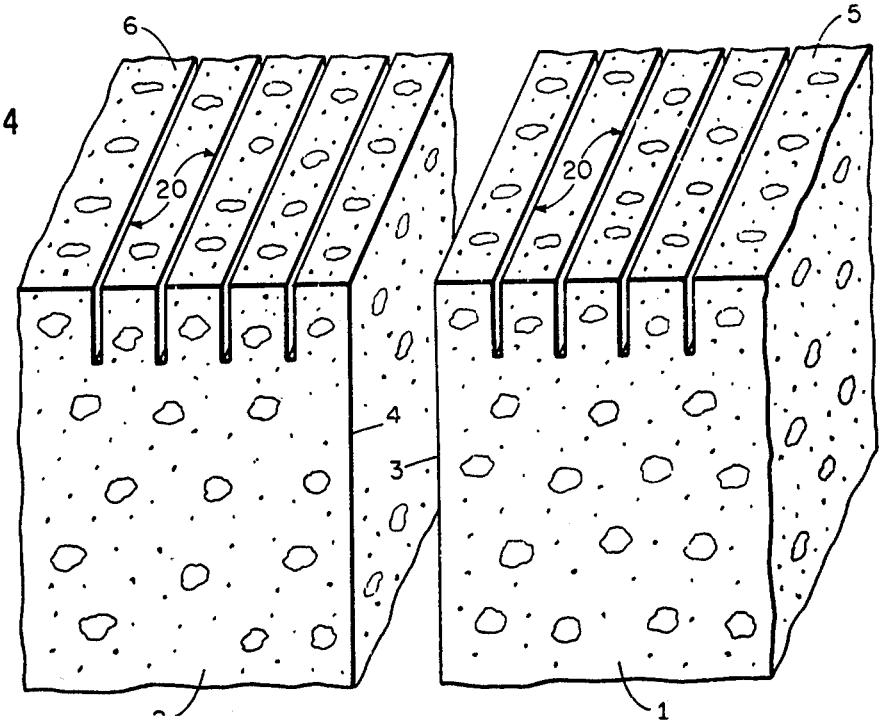
FIG. 4 is an illustration in perspective of a preferred method of making the recesses in the concrete sections shown in FIG. 1.

The first step in the method according to the invention is the provision of recesses 7 and 8 in concrete surfaces 1 and 2 as shown in FIG. 1. As aforementioned, these recesses can be made during the pouring of the concrete surfaces, e.g. using removable form members having the size and shape of the recesses. However, in a preferred procedure, the recesses are formed after the concrete sections have been fully formed without such recesses. After the concrete has hardened a number of generally parallel saw-cuts 20 in FIG. 4 are made along the horizontal extent of the joint in surfaces 5 and 6 on each side of the joint. The depth of the saw-cuts will determine the approximate depth of the recesses, which should in any event be greater than the cross-sectional height of the strip 9. The cut surface portions are then easily chipped or ground out to the approximate shape and size shown in FIG. 1. It may be necessary and/or desirable to apply a layer of rigid grouting material to the bottom of the recesses to give them a smooth, flat surface. A primer, e.g. epoxy when epoxy grout is used, may be desirable.

Figure 2:
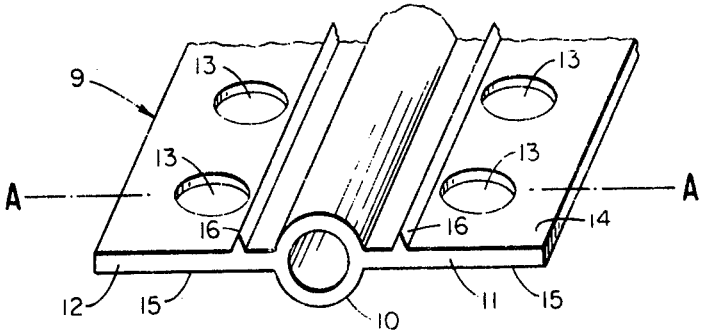
FIG. 2 is a perspective view of the joint-spanning strip 9 installed in the joint of FIG. 1.
Figure 3:
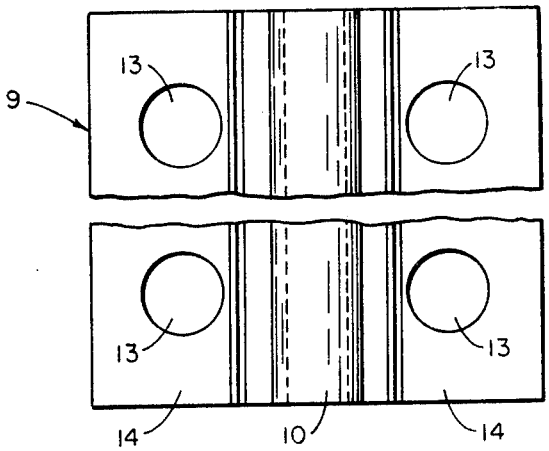
FIG. 3 is a top planar view of the spanning strip of FIG. 2.

Joint-spanning strip 9 is then layed into recesses 7 and 8 as shown in FIG. 1. As shown in FIGS. 2 and 3, the joint-spanner 9 is in the form of a continuous length of a flexible elastic strip material which in cross section has a center section 10, and lateral web portions 11 and 12 respectively, each extending outwardly from and on opposite side of, the center section. The web portions have a number of openings 13 therethrough connecting their upper surfaces 14 with their lower surfaces 15. The upper surfaces of the lateral web portions each further have an upstanding raised rib 16 located between openings 13 and center section 10 which runs continuously along the length of the strip as shown in FIGS. 2 and 3. It is preferred that the bottom surfaces 15 of webs 11 and 12 be substantially smooth surfaced as shown, that is have no similar raised or enlarged portions, which would prevent an even surface-to-surface contact between the bottom surfaces 15 of the webs and the bottom of recesses 7 and 8. The importance of maintaining such a contact is pointed out below.

In laying the joint-spanning strip 9 in the recesses, the bottom surfaces of each of web portions 11 and 12 are positioned adjacent the bottom surfaces of recesses 7 and 8 respectively. The strip is placed further such that only the central section 10 is positioned in the joint, the openings 13 and raised ribs 16 of each respective web 11 and 12 being positioned above concrete sections 1 and 2, respectively. A fluid grouting material 17 which will set or harden to a rigid mass is then placed over web portions 11 and 12, care being taken that openings 13 will be filled by the fluid grout. The surface of the grout is made even with the concrete surfaces 5 and 6 and thereafter allowed to set or harden.

In the event that a spaced joint such as the expansion joint shown in FIG. 1 is being sealed according to the method of the invention, the fluid grout material 17 must be prevented from entering the joint space above the center section as shown in FIG. 1. An easy method of accomplishing this is illustrated in FIG. 5. A spacer 18 in the form of a continuous strip of flexible material having a bottom surface configured such that it evenly contacts the upper surface of the center section 10 is placed on top of the center section before the grout is poured or placed. The spacer has a width corresponding to the width of the joint between concrete sections 1 and 2 and a height such that its upper surface is even with the surfaces 5 and 6 of concrete sections 1 and 2. The grout is then placed above webs 11 and 12 in the manner described previously to the height of spacer 18 and surfaces 5 and 6. The spacer is then removed preferably after the hardening of the grout.

The spacer 18 is most advantageously made of flexible material so that it can follow the contour of the center section. Moreover, a material which is also resilient and compressible is preferred in order that it will move with any corresponding movement of the joint before its removal, and thus be able to prevent grout from being damaged. A spacer further of a material which has poor adhesion to the grout and can be cut easily to fit would be obviously desirable. A preferred spacer is formed of flexible resilient synthetic resinous material such as polyvinyl chloride. The spacer can obviously be removably adhered to the center section 10 using for example a pressure sensitive adhesive having only sufficient adhesive properties to keep the spacer adhered to the strip 9 during placement of the grout but will permit removal of the spacer without damaging the strip. The surface of the strip should be cleaned, e.g. with a solvent, before adhering the spacer.

Openings 13 are of sufficiently large size to permit the fluid grout material to flow therein without undue effort. The size, that is volume, of each opening and number thereof are such that sufficient "reinforcing columns" of hardened grout are created along the horizontal extent of the sealed joint to support the overlying grout when such is stressed by traffic passing over it. A sufficient number and volume of such openings for this purpose should also normally provide for sufficient locking of the webs, and hence the joint-spanning strip itself to the concrete sections upon movement of such sections. For most grouting materials, openings 13 all of whose crosswise dimensions are at least about ¼, preferably about ¾, of an inch will suffice. The distance between each opening should not exceed about 1 to 2 inches to adequately support most grouts.

In the embodiments shown in the drawings, the joint-spanning strip 9 has a cross-sectional width of approximately 6 inches, the webs 11 and 12 a cross-sectional width or height of approximately ¼ inch, and the center section 10 a cross-sectional outside diameter of approximately 1 3/16 inch. The circular openings 13 shown in the strip have an approximate diameter of 1⅛ inch and are spaced approximately 1 inch apart in each web portion.

The center section 10 of the joint-spanning strip 9 may simply be smooth and continuous with the web portions 10 and 11 in applications where no or little movement between the concrete sections is anticipated, and no space is left between the concrete sections. As aforementioned, the joint shown in the drawings is spaced in the manner of a typical expansion joint, and in this case it is preferred that the center section 10 be configured such that it will stretch laterally beyond the normal elastic ability of the material from which it is made in order to insure that it will not rupture upon extreme separation of the opposed concrete sections. This is accomplished in the embodiment according to FIGS. 1—3 by making the center section in the form of a hollow round bulb. The central bulbous section will not only greatly expand laterally as the concrete sections separate but will also compress should the concrete sections move toward one another. The bulbous configuration also distorts satisfactorily should the concrete sections move upwardly and downwardly with respect to one another, that is, transversely. The center section could have an expansive center section other than a hollow bulb, for instance the deep "V" configuration shown in FIG. 7, or multiple "V", e.g. "W".

The upstanding ribs 16 provide greater assurance that water which enters the joint from concrete surfaces 5 and 6 will not pass around the upper surfaces of the webs 11 and 12 of the joint-spanning strip 9. When the joint is in its normal position shown in FIG. 1, water entering the joint from above, that is surfaces 5 and 6 of concrete sections 1 and 2, is prevented from passing further between the upper surfaces 14 of the webs 11 and 12 and the grout 17 at the points "B" shown in FIG. 1 by the contact between the rounded center section 10 and the grout, and also by the contact between the upper surfaces of the webs and the grout at the points "B". This sealing action is enhanced when the concrete sections move toward one another forcing greater contact between the surfaces of the grout and the strip 9. However, should the joint expand by separation of the concrete masses, contact between the center bulb and the grout at the points "B" is lessened, and the webs 11 and 12 become thinner at the points "B" as they are stretched. The result is a much greater possibility of water passing the contact points "B". Such passing water has direct access through and around the strip 9 via openings 13 since the openings themselves will be stretched and elongated when the concrete sections are moved apart from one another, which causes a separation between the inner surfaces of the openings 13 and the rigid "posts" of grout filling the openings. The upstanding ribs 16 will prevent such water passing points "B" from getting to the openings since as the concrete sections separate apart from one another and the webs thin at points "B", the ribs will be forced against the grout at points "C" in a tighter sealing relationship.

The upper surfaces of webs 11 and 12 can be provided with raised portions 19 in FIGS. 6 and 7 at the terminal ends thereof in order to increase the resistance of webs to withdrawal from the grout 17, and also to act in a manner similar to ribs 16 in preventing water from passing around the ends of webs 11 and 12.

The bottom surfaces 15 of webs 11 and 12, which are placed adjacent the bottom of recesses 7 and 8 are as aforementioned preferably flat in order to promote a smooth continuous surface-to-surface contact with the recess bottom. This insures that no voids will be created between such surfaces into which the flexible strip 9 can be forced by traffic passing over the joint, which in turn stresses the overlying rigid grout material above the point of the voids leading to undesirable cracking thereof.

The grouting material 17 employed in the method of the invention can be any material which is initially sufficiently fluid to flow into recesses 7 and 8 and openings 13; which is capable of setting, curing or hardening to a rigid mass; and, which has good adhesion to concrete. The grouting material is considerably more rigid than the flexible joint-spanning strip 9 and must be sufficiently rigid to withstand repeated impact by vehicle tires thereon, and also to prevent such tires passing over the joint from repeatedly contacting the portion of the joint-spanning strip 9 exposed at the joint opening.

A high flexural strength material such as exposy resin unfilled or filled with a particulate mineral filler such as sand is especially suited for use as the grouting material in the method of the invention. Upon addition of a curing agent to the resin, relatively fast-hardening grouting materials can be obtained. Good results have been obtained using "EPOXTITE GROUT", a product of W. R. Grace & Co., which is a two-component, mineral filled, thixotropic, flexible epoxy. Other rigid thermosetting synthetic resins which have similarly good adhesion to concrete are suitable also.

Another suitable grouting material for use herein comprises quicksetting inorganic cement compositions such as those based upon magnesium phosphate. A particularly quick-setting cement compositions of this type is described in U.S. Pat. No. 3,960,580 to Stierli et al. The compositions described in this patent develop sufficient compressive strengths to permit traffic thereover within hours. The quick-setting cements described therein are based upon the reaction between magnesium oxide and an ammonium phosphate and can be either one or two component mixtures.

Other possible grouting materials include Portland cement or gypsumbased mortars, etc., but the comparatively longer setting times for instance of these materials make them generally less desirable.

The joint-spanning strip 9 is typically installed such that the web portions are but about 1 to 2 inches from the surfaces 5 and 6 of the concrete sections. The upper surface of the center section 10 will thus be just beneath surfaces 5 and 6, say about ¼ inch, to avoid contact with traffic passing thereover. Installations such that the upper surface of the center section is deeper than about ½ inch should be avoided since the greater depth affords collection of dirt, ice, etc., in the joint space above the center section.

The joint-spanning strip can be of any synthetic or natural resinous material which is flexible and elastic or elastomeric. Neoprene rubber and polyvinyl chloride in particular have the desired physical properties, are resistant to deterioration in use, and can be molded or extruded to the configuration shown herein.

It is obvious that specific changes, substitutions, etc. can be made in the aforedescribed detailed description without departing from the spirit of the invention.

It is claimed:

1. A method of rendering an expansion joint formed between opposed surfaces of two adjacent spaced sections of concrete each having a further non-opposed, exposed traffic -bearing surface joining said opposed surface at an angle thereto at the locus of the joint, proof against passage of water and solids which enter the joint from the direction of said exposed surfaces, said method comprising the steps of;

(a) providing a pair of longitudinally-extending opposed recesses one each on each respective side of said joint and in each of said nonopposed, exposed surfaces of said concrete sections generally at the location where the said exposed surface joins the said opposed surface at the locus of the joint;

(b) providing a preformed joint-spanning and sealing element in the form of a continuous length of flexible elastic strip material having in cross-section a width greater than the width of said joint but not greater than the combined widths of said recesses across the joint, said strip further in cross-section having a center section and lateral web portions extending outwardly from and on opposite sides of said center section, each of said web portions in cross-section having broad upper and lower surfaces, narrower terminal end surfaces and a height less than the height of said recesses, said web portions each further having a plurality of preformed openings therethrough connecting said upper and lower surfaces and spaced from one another along the longitudinal extend of said strip and each a continuous, longitudinally extending rib raised from its upper surface and positioned between said center section and said openings, the number, dimensions and spacing of said openings being sufficient to accomodate the said amount of hardened grout specified in step (e) below;

(c) positioning the said joint-spanning strip in said recesses across said joint in a manner such that the lower surfaces of said web portions are adjacent the bottom of said recesses and the said center section lies in the joint space, and in a manner further such that one of said lateral webs, its openings therethrough, and its raised rib portion lie in and alongs the recess in one section of concrete and the other said lateral web, its openings, and raised rib portion lie in and along the opposed recess in said other section of concrete;

(d) covering said lateral webs by placing a layer of hardenable fluid grouting material having good adesion to concrete over the upper surface of an along the longitudinal extent of each of said lateral webs in said recesses to the height of said exposed surfaces of said concrete sections and causing said grouting material to enter and fill said openings and to contact the said recess bottom portions exposed by said openings, said fluid grouting material further being placed such that said raised ribs are embedded in said grout and the grout over each web terminates at said center section and does not enter the space between said concrete sections; and (e) thereafter allowing said grout to harden to a mass more rigid than said joint-spanning strip material, the amount of hardened grout in said openings being sufficient to prevent the upper, web-covering layers of grout from being flexed to the extent of cracking by repeated passage of traffic thereover over a reasonably extended period of time and to lock said lateral web portions to the respective concrete sections, the said raised ribs acting, by pressing against said hardened grout when the joint-spanning strip is stretched by movement of the joint, to prevent water entering the joint space from passing through the said openings.

2. The method of claim 1 wherein the said joint-spanning strip has a center section having a hollow bulbous configuration.

3. The method of claim 1 wherein said strip is comprised of a synthetic rubber.

4. The method of claim 1 wherein the combined width of the said recesses across the joint is greater than the cross-sectional width of said strip and the said upper and the said terminal end surfaces of said web portions are embedded in said grouting material.

5. The method of claim 1 wherein said lower surfaces of said lateral webs of said strip are substantially smooth.

6. The method of claim 1 wherein the terminal ends of said lateral webs have raised portions projecting upwardly from said upper surfaces.

7. The method of claim 1 wherein said recesses are made by first making a plurality of generally parallel saw-cuts in said exposed surface longitudinally thereof and on each side of said joint to the depth of the recess desired, and thereafter removing the concrete material between the saw-cuts.

8. The method of claim 1 wherein all cross-wise dimensions of the said openings through said webs are at least about ¼ inch, and said openings are spaced about 1 to 2 inches from one another.

9. The method of claim 1 wherein said grouting material comprises epoxy resin.

10. The method of claim 9 wherein the resin contains mineral filler particles.

11. A method of rendering an expansion joint formed between opposed surfaces of two spaced sections of concrete each having a further non-opposed, exposed traffic-bearing surface joining said opposed surface at an angle thereto at the locus of the joint, proof against passage of water and solids which enter the joint from the direction of said exposed surfaces, said method comprising the steps of:

(a) providing a pair of longitudinally-extending opposed recesses one each on each respective side of said joint and in each of said non-opposed, exposed traffic-bearing surfaces of said concrete sections generally at the location where the said exposed surface joins the said opposed surface at the locus of the joint;

(b) providing a pre-formed joint-spanning and sealing element in the form of a continuous length of flexible elastic strip material having in cross-section a width greater than the width of said joint but not greater than the combined widths of said recesses across the joint, said strip further in cross-section having a center section and laterial web portions extending outwardly from and on opposite sides of said center section, each of said web portions in cross-section having broad upper and substantially smooth lower surfaces, narrower terminal end surfaces and a height less than the height of said recesses, said web portions each having a plurality of pre-formed openings therethrough having all cross-wise dimensions greater than about ¼ inch connecting said upper and lower surfaces and spaced from one another a distance not exceeding about 1 to 2 inches along the longitudinal extent of said strip, each web portion further having a continuous, longitudinally-extending rib raised from its said upper surface located between said center section and said openings;

(c) positioning the said joint-spanning strip in said recesses across said joint in a manner such that the smooth lower surfaces of said web portions are adjacent the bottom of said recesses and the said center section lies in the joint space, and in a manner further such that one of said lateral webs, its openings therethrough, and its raised rib portion lie in and along the recess in one section of concrete and the other said lateral web, openings and raised rib portion lie in and along the opposed recess in said other section of concrete;

(d) covering said lateral webs by placing a layer of hardenable fluid grouting material having good adhesion to concrete over the upper surface of and along the longitudinal extent of each of said lateral webs in said recesses to the height of said exposed surfaces of said concrete sections and causing said grouting material to enter and fill said openings and to contact the said recess bottom portions exposed by said openings, said fluid grouting material further being placed such that said raised ribs are embedded in said grout and the grout over each web terminates at said center section and does not enter the space between said concrete sections; and (e) thereafter allowing said grout to harden to a mass more rigid than said joint-spanning strip material, the amount of hardened grout in said openings being sufficient to prevent the upper, web-covering layers of grout from being flexed to the extent of cracking by repeated passage of traffic thereover over a reasonably extended period of time and to lock said lateral web portions to the respective concrete sections, the said raised ribs acting, by pressing against said hardened grout when the joint-spanning strip is stretched by movement of the joint, to prevent water entering the joint space from passing through the said openings.

12. The method of claim 11 wherein said strip material is comprised of neoprene rubber, or of polyvinyl chloride.

13. The method of claim 11 wherein said recesses are made to a depth of about 1 to 2 inches in the said exposed concrete surfaces.

14. The method of claim 11 wherein the upper surface of said center section in said joint space is below the surface of the covering layers of grout.

15. The method of claim 14, wherein the said upper surface of said center section is no deeper than about ½ inch from said grout surface.

16. A method of rendering an expansion joint formed between opposed surfaces of two spaced adjacent sections of concrete each having a further non-opposed, exposed traffic-bearing surface joining said opposed surface at an angle thereto at the locus of the joint, proof against passage of water and solids which enter the joint from the direction of said exposed surfaces, said method comprising the steps of;

(a) providing a pair of longitudinally-extending opposed recesses one each on each respective side of said joint and in each of the said non-opposed, exposed surfaces of said concrete sections generally at the location where the said exposed surface joins the said opposed surface at the locus of the joint;

(b) providing a pre-formed joint-spanning and sealing element in the form of a continuous length of flexible elastic strip material having in cross-section a width greater than the width of said joint but not greater than the combined widths of said recesses across the joint, said strip further in cross-section having a center section and lateral web portions extending outwardly from and on opposite sides of said center section, each of said web portions in cross-section having broad upper and lower surfaces, narrower terminal end surfaces and a height less than the height of said recesses, said web portions each further having a plurality of pre-formed openings therethrough connecting said upper and lower surfaces and spaced from one another along the longitudinal extent of said strip and each a continuous, longitudinally-extending rib raised from its upper surface and positioned between said center section and said openings, the number, dimensions and spacing of said openings being sufficient to accomodate the said amount of hardened grout specified in step (f) below;

(c) positioning the said joint-spanning strip in said recesses across said joint in a manner such that the lower surfaces of said web portions are adjacent the bottom of said recesses and the said center section lies in said spaced joint, and in a manner further such that one of said lateral webs, its openings therethrough, and its raised rib portion lie in and along the recess in one section of concrete and the other said lateral web, openings and rib lie in and along the opposed recess in said other section of concrete;

(d) providing a removable spacing element having a planar upper surface and a lower surface defining the height of the spacing element and two outer side surfaces defining the width of the spacing element, and positioning the said lower surface of said spacing element above the said center section of said joint-spanning strip and in contact therewith, the said spacing element having a width substantially that of the width of the space between said opposed concrete sections and a height such that its upper surface is substantially even with the said non-opposed, exposed surfaces of said concrete sections;

(e) placing a layer of fluid, hardenable, grouting material over the upper surfaces of and along the longitudinal extent of each of said lateral webs in said recesses to the height of the upper surface of said spacing element and said non-opposed, exposed surfaces, and causing said grouting material to enter and fill said openings in said webs;

(f) allowing said grout to harden to a mass more rigid than said joint-spanning strip material, the amount of hardened grout in said openings being sufficient to prevent the upper web-covering layers of grout from being flexed to the extent of cracking by repeated passage of traffic thereover over a reasonably extended period of time and to lock said lateral web portions to the respective concrete section, the said raised ribs acting, by pressing against said hardened grout when the joint-spanning strip is stetched by movement of the joint, to prevent water entering the joint space from passing through the said openings; and

17. The method of claim 16 wherein said grouting material comprises an epoxy resin.

18. The method of claim 16 wherein the lower surface of said spacing element is configured such that it is in even surface-to-surface contact with the upper surface of said center section.

19. The method of claim 16 wherein the spacing element is adhesively joined to the center section using an adhesive which maintains the element in position during said placing of said grouting material, yet permits said element to be removed later without damage to said center section.

20. The method of claim 16 wherein said spacing element is comprised of polyvinyl chloride.

21. The method of claim 16 wherein said spacing element is flexible.

22. The method of claim 21 wherein said spacing element is resilient and compressible.

* * * * *